US005454204A

United States Patent [19]

Jordal

[11] Patent Number: 5,454,204

[45] Date of Patent: Oct. 3, 1995

[54] WINDOW FRAME EXTRUSION AND METHOD

[76] Inventor: Robert L. Jordal, Rte. 10, Box 351, Winston-Salem, N.C. 27127

[21] Appl. No.: 181,776

[22] Filed: Jan. 18, 1994

[51] Int. Cl.[6] ..... E04C 3/30

[52] U.S. Cl. ..... 52/730.3; 52/730.4; 49/DIG. 2; 49/504

[58] Field of Search ..... 52/730.3, 730.4, 52/730.5, 730.6, 407.1, 407.2, 406.3, 732.1, 732.2; 49/DIG. 1, 704

[56] References Cited

U.S. PATENT DOCUMENTS 4,283,895 8/1981 Sykolics ..... 49/DIG. 7

FOREIGN PATENT DOCUMENTS 1245567 7/1907 Germany ..... 49/DIG. 1

*Primary Examiner*—Carl D. Friedman
*Assistant Examiner*—Creighton Smith

[57] ABSTRACT

An extruded aluminum window frame is shown having a thermal barrier held in place within the extrusion by channels having circular C-shaped insulation end pockets. An extrusion bridge is preferably located between the circular C-shaped insulation pockets in skip-debridged form within a polyurethane thermal barrier or may be conventionally located below the polyurethane thermal barrier for entire removal.

13 Claims, 2 Drawing Sheets

WINDOW FRAME EXTRUSION AND METHOD

BACKGROUND OF THE INVENTION

1. Field of the Invention

The invention herein pertains to window frame extrusions which are used with window installations, wall systems, and doors and particularly pertains to window frame extrusions having a thermal insulation component.

1. Description Of The Prior Art And Objectives of the Invention

Metal window frames are increasingly used in replacing wooden window frames due to their greater strength, durability and ease of assembly. Such metal window frames are commonly formed from aluminum extrusions, which are manufactured by forcing molten aluminum through a die. By using differently shaped dies, nearly any shape of extrusion imaginable can be created. Due to the limitless shape possibilities, extruded aluminum window frames are much more versatile than wooden window frames. However, wooden window frames do have one distinct advantage over aluminum extrusions in that wooden window frames are much better insulators. To help alleviate the problems associated with heat loss, aluminum window frame extrusions commonly include an insulation component to prevent heat from being conducted to the outdoors from a heated building or from the outdoors into an air conditioned building.

Many conventional insulated aluminum extrusions are created by first manufacturing an extrusion having a bridge connecting two halves of the extrusion together. Adjacent to the bridge is a longitudinal channel for holding insulation. Insulation such as a suitable polyurethane is poured into the channel above the bridge and then is allowed to harden or cure. The bridge is then removed, so as to prevent heat loss, by milling or sawing leaving the two halves of the aluminum extrusion separated by a hardened polyurethane thermal barrier. Sometimes the bridge is removed in part leaving small segments connecting the two halves of the aluminum extrusion adjacent the polyurethane thermal barrier. This is called "skip-debridging." Such a removal process provides structural integrity while allowing only a negligible amount of heat loss through the remainig bridge portions. The channel pockets for holding the hardened polyurethane thermal barrier in the aluminum extrusion are commonly angular or of a square C-shaped configuration. Conventionally, only one thermal end pocket is provided for each half of the aluminum extrusion to hold the thermal barrier in place therebetween.

Problems of conventional aluminum window frame extrusions are many. Single, square-shaped thermal pockets often do not tightly hold a polyurethane thermal barrier in place. Conventional configurations often do not hold the thermal barrier in place with even pressure. Conventional extrusions with square-shaped thermal end pockets have separate screw locking ports that do not adequately retain screws or bolts which are positioned longitudinally therein to, for example, hold a window frame together, since screws only bite into an aluminum port in a conventional extrusion and not into insulation as well, which helps lock screws into place, and this limited "bite" may not allow the necessary torque to sufficiently hold a window frame together. Separate screw locking ports also take up space, which may be at a premium when a compact extrusion is required. Conventional debridging leaves a jagged, sharp edge on one side of the extrusion, which can be dangerous and gives an unfinished appearance.

Thus, with the problems and disadvantages of the prior art window frame extrusions, the present invention was conceived and one of its objectives is to provide a window frame extrusion utilizing the desired characteristics of both wood and aluminum.

It is another objective of the present invention to provide a window frame extrusion which has a thermal barrier.

It is yet another objective of the present invention to provide a window frame extrusion which has a thermal barrier with an internal structural reinforcement.

It is also an objective of the present invention to provide a window frame extrusion with a pocket for more effectively holding and retaining a thermal barrier.

It is still another objective of the present invention to provide a window frame extrusion having a thermal barrier end pocket which more evenly distributes loads on the thermal barrier.

It is yet another objective of the present invention to provide a window frame extrusion that has improved torsional resistance.

It is a further objective of the present invention to provide a window frame extrusion that allows heavier loading.

It is additionally an objective of the present invention to provide a window frame extrusion that has a smooth, finished appearance on both sides of the insulation component.

It is also an objective of the present invention to provide a window frame extrusion with a thermal barrier end pocket having an integral screw locking port which enables a threaded member to secure a firm grip on the extrusion in a window frame installation.

It is still another objective of the present invention to provide a window frame extrusion that is more compact than conventional window frame extrusions having separate screw locking ports.

It is a further objective of the present invention to provide a method of making a window frame extrusion with the aforementioned characteristics.

Various other objectives and advantages of the present invention will become apparent to those skilled in the art as a more detailed description is set forth below.

SUMMARY OF THE INVENTION

The aforesaid and other objectives are realized by providing a window frame extrusion and method and particularly a window frame extrusion consisting of an elongated extruded aluminum member having at least one channel for retaining a thermal barrier of hardened polymeric insulation such as polyurethane. Each channel has circular C-shaped opposing lateral ends which form pockets for holding the thermal barrier in place. The extrusion may have an aluminum bridge formed between both of the channels for retaining liquid insulation material while it is being poured. This bridge may then be removed, after the insulation material has hardened, either entirely or in segments by a procedure known in the trade as skip-debridging. A bridge may also be located beneath two such channels.

The window frame extrusion of the invention can be created by a method employing a pair of vertically aligned elongated parallel channels with a centrally located bridge and completing the following steps: (1) pouring liquid insulation material into a top channel having circular C-shaped thermal end pockets; (2) allowing the insulation material to harden; (3) removing portions of the bridge by skip-debridging; (4) inverting the extrusion; (5) pouring additional liquid insulation material into the second channel; and (6) allowing the additional insulation to harden. The remaining segments of the bridge are thereby sandwiched within the hardened insulation. Window frames formed from such extrusions are joined by threaded members inserted into the circular C-shaped thermal end pockets of the channels that serve as screw lockig ports and substantially surround the threaded members to provide rigid, tight joints.

DESCRIPTION OF THE PREFERRED EMBODIMENT

Figure 1:
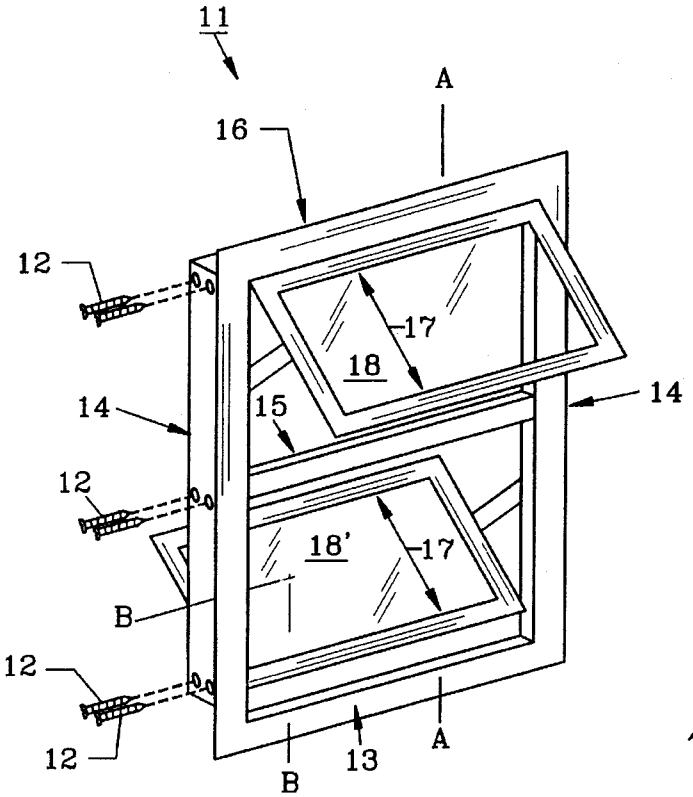
FIG. 1 illustrates a projected-type window frame formed from extrusions of the invention.
Figure 5:
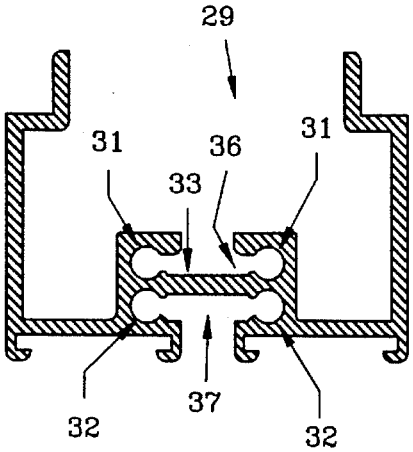
FIG. 5 pictures the preferred embodiment of the extrusion with a bridge located between the two channels.
Figure 6:
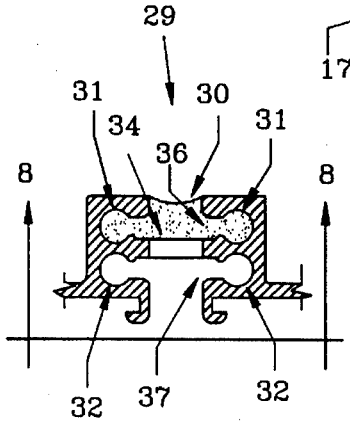
FIG. 6 illustrates the extrusion of FIG. 5 after filling one channel with insulation and after skip-debridging.
Figure 7:
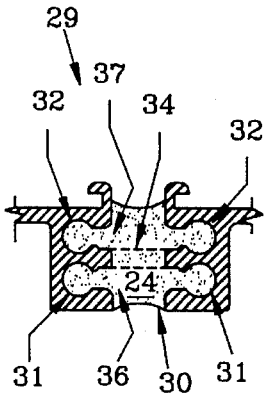
FIG. 7 depicts the extrusion of FIG. 6 after inverting the extrusion and filling the second channel with insulation.
Figure 8:
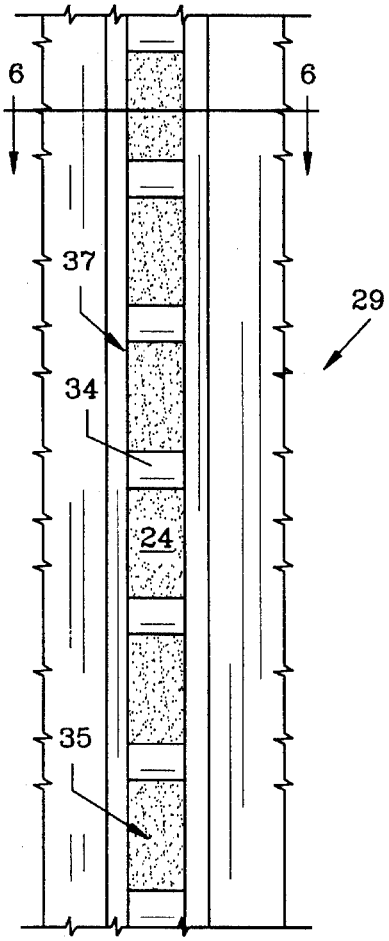
FIG. 8 reveals a bottom view of the extrusion of FIG. 6 as seen after skip-debridging but before inverting the extrusion and pouring insulation into its second channel.

The preferred form of the window frame extrusion of the invention is shown in FIGS. 1, 5, 6, 7 and 8 whereby an aluminum extrusion is formed with four circular C-shaped thermal insulation pockets at the ends of two vertically aligned elongated parallel channels. The circular C-shape of the pockets can also be described as an incomplete circle. FIG. 1 shows a typical window frame having projected windows formed from header, sill, side jamb and center support extrusions as described above. A better view of the invention, as seen in cross section, is shown in FIGS. 5, 6 and 7. FIG. 5 shows a newly formed extrusion having vertically aligned elongated parallel channels with circular C-shaped thermal end pockets and an aluminum bridge between the channels. FIG. 6 shows the extrusion of FIG. 5 after a liquid polymeric insulation material, such as polyurethane, has been poured into the top channel. After hardening, the polyurethane insulation forms a thermal barrier which acts as a stable connecting support between the two ends of the channel and thus the extruded bridge is of decreased importance. Therefore, the bridge may be partially removed, as shown in FIG. 6, by skip-debridging to lessen heat transfer while retaining some structural integrity. The extrusion is then inverted so that the remaining empty channel is on top where it can be filled with additional insulation material, as shown in FIG. 7. After the second filling, the double channeled thermal barrier area of the extrusion contains hardened polyurethane insulation and in this embodiment encompasses remaining portions of the once continuous bridge to provide additional strength. FIG. 8 shows a bottom view of FIG. 6 before inverting the extrusion and filling the second channel. Here can be clearly seen the skips (voids) in the bridge after skip-debridging, whereby small segments of the bridge remain for additional structural support.

DETAILED DESCRIPTION OF THE DRAWINGS AND OPERATION OF THE INVENTION

For a better understanding of the invention, turning now to the drawings, FIG. 1 depicts a typical projected-type window frame 11 of the invention containing horizontal sill extrusion 13, center horizontal support extrusion 15, and horizontal header extrusion 16. Glass panes 18 are held in window frame 11 by extrusions 17. On each side of window frame 11 are vertical side jamb extrusions 14 with threaded members 12 shown holding window frame 11 together by insertion through the sides of jamb extrusions 14 and into the ends of sill extrusion 13, center support extrusion 15, and header extrusion 16.

Figure 2:
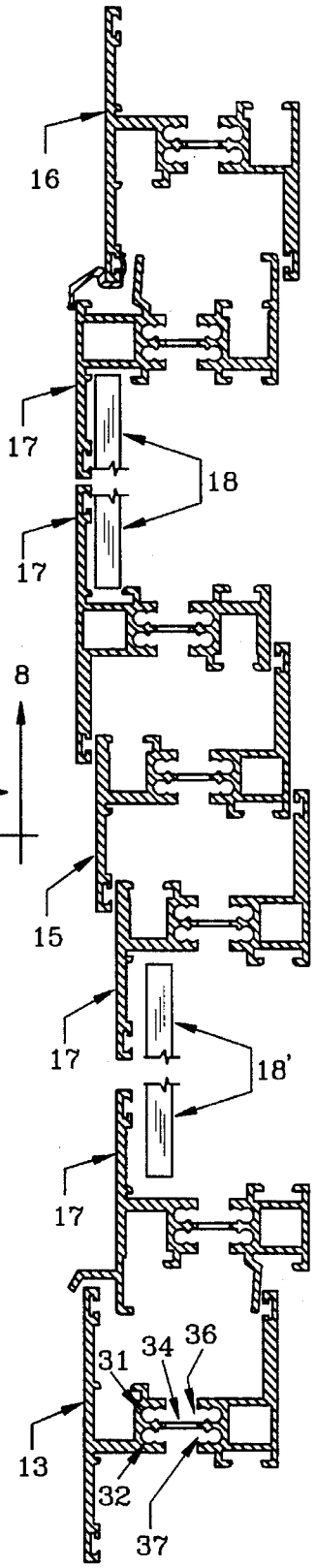
FIG. 2 shows a schematic representation of an elevational cross-sectional view of the projected-type window frame of FIG. 1 along line A—A.

A schematic representation of a cross-sectional, elevational side view of projected window frame 11 of FIG. 1, along line A—A, is depicted in FIG. 2 where the ends of glass panes 18, 18' and extrusions 13, 15, 16 and 17 of window frame 11 are seen. Glass panes 18, 18' are shown in partial form and in approximate positions for illustrative purposes and connectors and seals are not shown for clarity. Extrusions 13, 15, 16, and 17 of FIG. 2 are depicted with skip-debridged central bridges 34 and without insulation for clarity.

Figure 3:
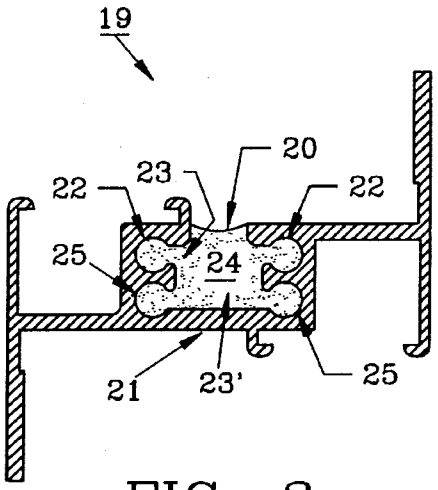
FIG. 3 depicts a cross-sectional view of an embodiment of the invention with a bridge located below both channels.

An enlarged and more detailed view of an alternate embodiment, extrusion 19, is shown in FIG. 3. Extrusion 19, with bottom-bridged thermal barrier 20, can be seen with vertically aligned elongated parallel channels 23, 23' having two pairs of circular C-shaped thermal end pockets 22, 25. Bottom bridge 21, located beneath both channels 23, 23', is depicted in place in this figure. First channel 23 has circular C-shaped (having a single radius but an incomplete circumference) thermal end pockets 22 at each of its lateral ends and second channel 23' also has circular C-shaped thermal end pockets 25 at each of its lateral ends. Polyurethane insulation 24, seen after pouring and hardening, entirely fills both channels 23, 23' and circular C-shaped thermal end pockets 22, 25.

Figure 4:
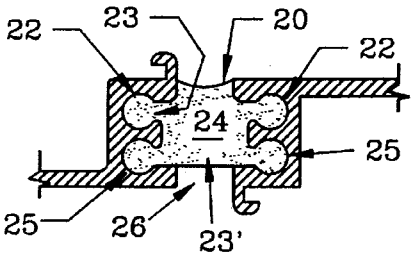
FIG. 4 shows the extrusion of FIG. 3 after debridging.

FIG. 4 shows extrusion 19 of FIG. 3 after debridging (as depicted by space 26) along the bottom of thermal barrier 20. It can be readily seen that thermal barrier 20 is the only connecting means between both sides of now divided extrusion 19. Thermal barrier 20 is held tightly in place between both halves of extrusion 19 by circular C-shaped thermal end pockets 22, 25 on each end of channels 23, 23'.

The preferred embodiment of the invention, extrusion 29, is shown in FIG. 5 with center-bridged thermal barrier 30 and central bridge 33. Circular C-shaped thermal end pockets 31, 32 can be seen on both sides of central bridge 33 at the ends of vertically aligned elongated parallel first (top) and second (bottom) channels 36, 37 respectively. Center-bridged thermal barrier 30 of extrusion 29 can be seen in FIG. 6 after polyurethane insulation 24 has been poured into top channel 36 and central bridge 34 has been partially removed by skip-debridging, leaving spaces 35.

Extrusion 29 is shown in FIG. 7 after inverting and filling second channel 37 with polyurethane insulation 24, which fills second channel 37 and spaces 35 left after skip-debridging. This way, portions of central bridge 34 are left enclosed within center-bridged thermal barrier 30 to provide strength to extrusion 29 yet allow only minimal heat transfer from one side of extrusion 29 to the other. Also, both sides of center-bridged thermal barrier 30 have a smooth, finished appearance since insulation 24 was poured from both sides. This is in contrast to thermal barrier 20 of extrusion 19 shown in FIG. 4 and to conventional extrusions, which have sharp edges left after debridging.

A bottom view of extrusion 29, as shown in FIG. 6, is seen in FIG. 8 before inversion of extrusions 29 and filling of second channel 37 with polyurethane insulation 24 (as depicted in FIG. 7). Here skips 35 of central bridge 34 are clearly seen. FIG. 6 can also be seen as a cross section of extrusion 29 as shown in FIG. 8.

Figure 9:
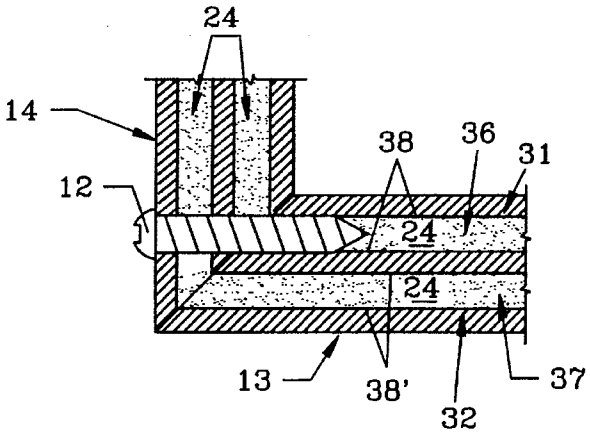
FIG. 9 depicts an enlarged cross-sectional view of a corner joint of the window frame as shown in FIG. 1 along lines B—B.

A close-up cross-sectional view of a corner joint in window frame 11, as shown in FIG. 1 along lines B—B, is depicted in FIG. 9. Here the juncture of sill extrusion 13 and side jamb extrusion 14 can been seen held together by threaded member 12 (threaded member not seen in cross sectional presentation ). Threaded member 12 is seen positioned in a hole drilled through extrusion 14 and into top thermal pocket 31, which serves as a screw locking port, at end of top channel 36 of extrusion 13. Insulation 24 has been drilled away and threaded member 12 is sized to bite into the inside wall 38 of thermal pocket 31, the outside diameter of threaded member 12 being slightly larger than the inside diameter of thermal pocket 31. Here can be clearly seen the engagement of threaded member 12 with the inside wall 38 of top thermal pocket 31. Because of the circular C-shape of pocket 31, approximately eighty percent of the external circumference of threaded member 12 contacts the entire arc of inside wall 38 along the length of threaded member 12.

The illustrations and examples provided herein are for explanatory purposes and are not intended to limit the scope of the appended claims.

I claim:

1. An insulated window having frame sections to form an opening for containing window panes, each of said frame sections comprising: an elongated rigid member, said rigid member having an outer surface defining a first channel, said first channel extending longitudinally along said rigid member, said first channel having circular C-shaped opposing lateral end pockets, a threaded member, said threaded member positioned longitudinally within said circular C-shaped end pocket of said channel.

2. The window of claim 1 wherein said rigid member defines a second channel, said second channel extending longitudinally along said rigid member parallel to said first channel.

3. The window of claim 2 wherein said second channel has circular C-shaped opposing lateral end pockets.

4. The window of claim 3 wherein an insulating material is positioned within said first channel.

5. An insulated window having frame sections to form an opening for containing window panes, each of said frame sections comprising: an elongated rigid member, said rigid member having an outer surface defining a first channel, said first channel extending longitudinally along said rigid member, said first channel having circular C-shaped opposing lateral end pockets, an insulating material, said insulating material positioned within said first channel to prevent heat transfer, said rigid member outer surface defining a second channel, said second channel extending longitudinally along said rigid member parallel to said first channel and including a channel bridge, said channel bridge extending longitudinally along said rigid member between said first and said second channels, wherein said channel bridge is slotted.

6. The window of claim 5 wherein said frame sections form a rectangular opening.

7. The window of claim 5 wherein said insulating material is positioned within said second channel

8. A method of manufacturing an elongated rigid frame member for a window having a first and a second longitudinal channel, a channel bridge extending longitudinally between said first and second channel, comprising the steps of:

(a) filling the first longitudinal channel with an insulating material;

(b) removing a section of said channel bridge;

(c) inverting said rigid frame member; and (d) filling said second channel with insulating material.

9. An extrusion comprising: an elongated rigid member, said member having an outer surface defining a first and a second channel, said channels extending longitudinally along said member, said channels having circular C-shaped opposing lateral end pockets and a channel bridge, wherein said channel bridge is slotted and extends longitudinally along said elongated member.

10. The extrusion of claim 9 and including an insulating material, said insulating material positioned within said first channel.

11. The extrusion of claim 9 and including an insulating material, said insulating material positioned within said second channel.

12. The extrusion of claim 9 wherein said bridge extends longitudinally along said elongated member between said first and second channels.

13. The extrusion of claim 9 and including a threaded member, said threaded member positioned longitudinally within said circular C-shaped end pocket of said channel.

* * * * *